US008721064B2

(12) United States Patent
Miyamoto et al.

(10) Patent No.: US 8,721,064 B2
(45) Date of Patent: May 13, 2014

(54) PRINTING APPARATUS

(75) Inventors: Kazuko Miyamoto, Matsumoto (JP); Hiroshi Miyazawa, Okaya (JP); Toru Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/596,814

(22) Filed: Aug. 28, 2012

(65) Prior Publication Data

US 2013/0057629 A1 Mar. 7, 2013

(30) Foreign Application Priority Data

Sep. 2, 2011 (JP) ..... 2011-191460

(51) Int. Cl.
*B41J 11/00* (2006.01)

(52) U.S. Cl.
CPC ..... *B41J 11/00* (2013.01); *B41J 11/0005* (2013.01)
USPC ..... 347/102; 347/104

(58) Field of Classification Search
CPC ..... B41J 11/0005; B41J 11/00
USPC ..... 347/101, 102, 104; 399/406
See application file for complete search history.

(56) References Cited

U.S. PATENT DOCUMENTS

| | | | | |
|---|---|---|---|---|
| 7,954,939 | B2 * | 6/2011 | Yamamoto et al. | 347/104 |
| 2009/0189337 | A1 * | 7/2009 | Yamamoto | 271/189 |
| 2009/0190982 | A1 * | 7/2009 | Yamamoto | 399/406 |
| 2009/0190983 | A1 | 7/2009 | Yamamoto et al. | |
| 2009/0190984 | A1 * | 7/2009 | Yamamoto et al. | 399/406 |
| 2009/0190985 | A1 * | 7/2009 | Yamamoto et al. | 399/406 |
| 2011/0228289 | A1 | 9/2011 | Yamamoto et al. | |

FOREIGN PATENT DOCUMENTS

| | | |
|---|---|---|
| JP | 2009-45861 | 5/2009 |
| JP | 2009-179417 | 8/2009 |
| JP | 2010-125818 | 6/2010 |

* cited by examiner

*Primary Examiner* — Huan Tran
(74) *Attorney, Agent, or Firm* — Workman Nydegger

(57) ABSTRACT

A printing apparatus includes a transport unit that transports a printing medium to a downstream side of a transport direction, a printing head that performs printing on the printing medium, a drying unit that performs a drying process on the printing medium in the course of a transport path of the printing medium, a transport roller that is disposed further to the downstream side in the transport direction than the drying unit, a de-curl roller that pinches the printing medium with the transport roller, and a curl correcting unit that corrects the curl of the printing medium, and the de-curl roller is positioned at a de-curl position of pinching the printing medium with the transport roller at the time of increasing the temperature of the drying unit to a predetermined temperature.

7 Claims, 7 Drawing Sheets

DECAL-ON STATE

DECAL-OFF STATE

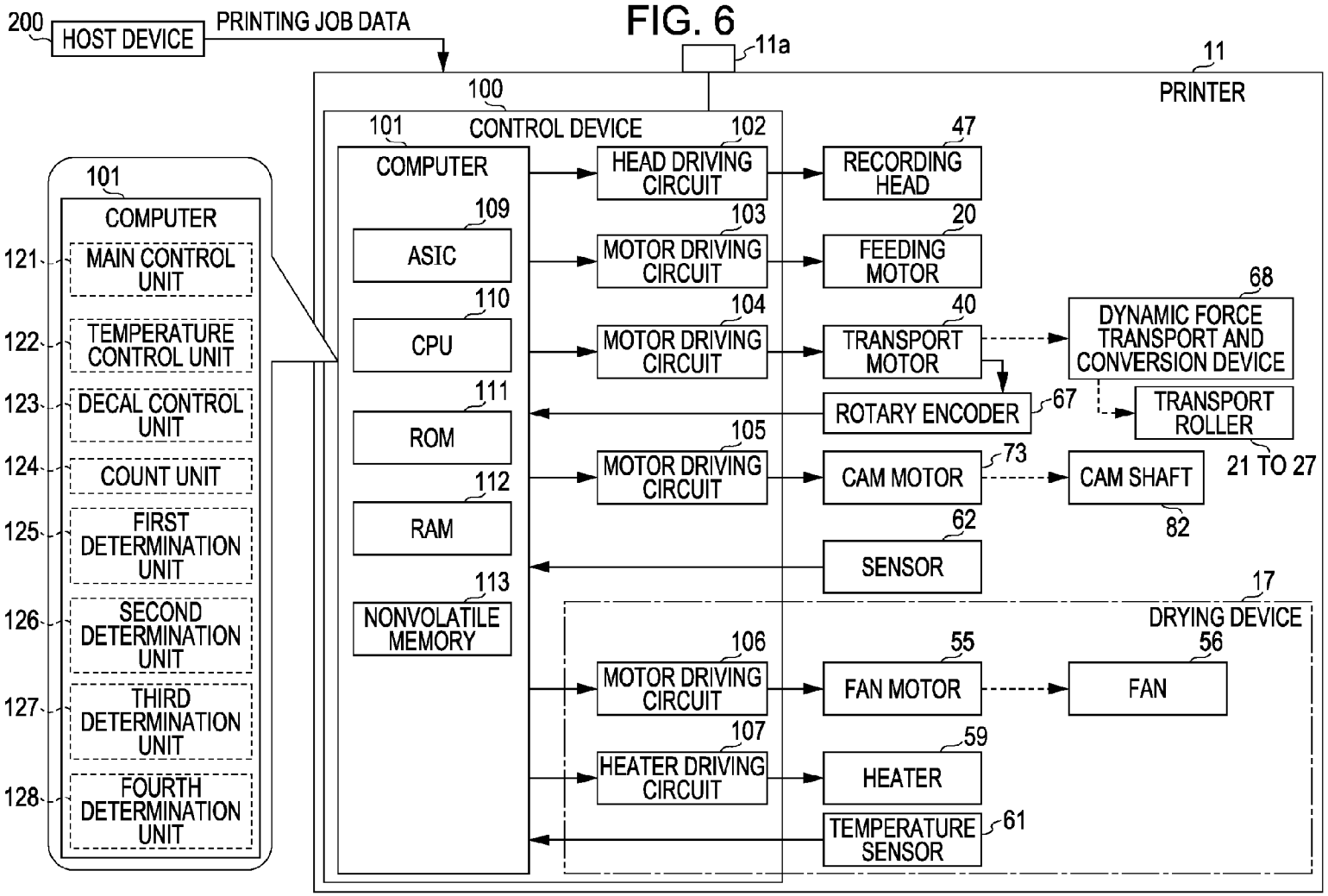
FIG. 6
11
PRINTER
11a
100
CONTROL DEVICE
101
COMPUTER
109
ASIC
110
CPU
111
ROM
112
RAM
113
NONVOLATILE MEMORY
102
HEAD DRIVING CIRCUIT
103
MOTOR DRIVING CIRCUIT
104
MOTOR DRIVING CIRCUIT
105
MOTOR DRIVING CIRCUIT
106
MOTOR DRIVING CIRCUIT
107
HEATER DRIVING CIRCUIT
47
RECORDING HEAD
20
FEEDING MOTOR
40
TRANSPORT MOTOR
67
ROTARY ENCODER
73
CAM MOTOR
62
SENSOR
55
FAN MOTOR
59
HEATER
61
TEMPERATURE SENSOR
68
DYNAMIC FORCE TRANSPORT AND CONVERSION DEVICE
21 TO 27
TRANSPORT ROLLER
82
CAM SHAFT
17
DRYING DEVICE
56
FAN
PRINTING JOB DATA
200
HOST DEVICE
101
COMPUTER
MAIN CONTROL UNIT
TEMPERATURE CONTROL UNIT
DECAL CONTROL UNIT
COUNT UNIT
FIRST DETERMINATION UNIT
SECOND DETERMINATION UNIT
THIRD DETERMINATION UNIT
FOURTH DETERMINATION UNIT
121
122
123
124
125
126
127
128

PRINTING APPARATUS

BACKGROUND

This application claims priority to Japanese Patent Application No. 2011-191460 filed on Sep. 2, 2011. The entire disclosure of Japanese Patent Application No. 2011-191460 is hereby incorporated herein by reference.

1. Technical Field

The present invention relates to a printing apparatus including a drying unit that blows out dry air to perform a drying process on a printing medium to which a liquid is adhered by a printing head, a curl correcting unit that corrects curling of the printing medium further to the downstream side of a transport direction of the printing medium than the drying unit.

2. Related Art

Generally, as a printing apparatus that adheres a liquid onto a printing medium to perform printing, an ink jet printing apparatus is widely known. In such a kind of printing apparatus, a drying device for drying the ink (liquid)-adhered printing medium in the course of transport is provided on the transport path of the printing medium (for example, JP-A-2009-045861 and JP-A-2009-179417).

For example, the drying device disclosed in JP-A-2009-045861 includes a suction intake fan for introducing air from the outside into a case, a heater for heating the air introduced into the case, an outlet for blowing the dry air formed by heating the air to the printing medium after the image printing, and a circulation space that leads the dry air blown from the outlet to the suction intake fan again. The dry air is circulated while being blown to the printing medium, the temperature of the dry air is increased (warmed up) to a target temperature (a predetermined temperature) for a short time, and the ink adhering to the printing medium is efficiently dried. The printing medium after the drying is discharged to the downstream side in the transport direction of the drying device.

In the printing device disclosed in JP-A-2009-179417, a de-curl mechanism that corrects curling the dry printing medium (sheet) after the printing is provided at a position further to the downstream side in the transport direction than the drying device. The de-curl mechanism is provided with a de-curl roller and a transport roller. When the curl correction is not performed, the de-curl roller is disposed at a non-de-curl position separated from the transport roller. When the curl correction is performed, the de-curl roller is disposed at a de-curl position coming into contact with the transport roller.

Under the drying device, the dried air (warm air) ejected from the outlet onto the surface of the printing medium remains between a pair of discharge rollers provided on the upstream side and the downstream side in the transport direction with respect to the outlet, and thus a relatively high temperature drying area is formed. When the printing medium after printing passes through the drying area, the drying of the ink is promoted by the heat of the heated air remaining in the drying area. However, there is a gap in a drying area forming member such as a discharge roller for forming the drying area, the warm air escapes from the gap, the temperature of the drying area decreases, and thus the drying efficiency is decreased.

In the printing apparatus provided with the de-curl mechanism disclosed in JP-A-2009-179417, the sheet is not transported during warming-up of the drying device, and thus the de-curl roller is disposed at the non-de-curl position. For this reason, the warm air exiting from the gap of the drying area forming member such as the discharge roller is discharged to the outside of the printing apparatus through a gap between the de-curl roller and the transport roller as a flow path, from the drying area formed under the drying device. When an air current in which the air of the drying area is discharged to the outside of the printing apparatus is generated, a necessary time until the temperature of the drying area reaches a temperature suitable for drying after the temperature increase of the drying device is started tends to be relatively increased, and a waiting time until it is possible to start printing after supplying power tends to be increased.

SUMMARY

An advantage of some aspects of the invention is to provide a printing apparatus capable of rapidly increasing a temperature of a drying area formed by remaining of dry air blown from an ejecting port of a drying unit during an increase in temperature of the drying unit.

According to an aspect of the invention, there is provided a printing apparatus including: a transport unit that transports a printing medium subjected to recording by attachment of a liquid from an upstream side to a downstream side in a transport direction; a printing head that performs printing on the printing medium in the course of a transport path; a drying unit that performs a drying process on the printing medium in the course of the transport path of the printing medium; and a curl correcting unit that has a transport roller disposed further to the downstream side in the transport direction than the drying unit and a de-curl roller pinching the printing medium with the transport roller, and corrects curling of the printing medium, wherein the de-curl roller moves between a de-curl position of pinching the printing medium with the transport roller and a non-de-curl position of being separated from the transport roller, and wherein the de-curl roller is positioned at the de-curl position when increasing the drying unit to a predetermined temperature.

With such a configuration, the de-curl roller is positioned at the de-curl position at the temperature raising time (warming-up) of raising the drying unit to a predetermined temperature. The de-curl roller positioned at the de-curl position comes in contact with the transport roller or approaches the transport roller as much as it is possible to pinch the printing medium, and thus it is possible rapidly raise the temperature of the drying area. As a result, it is possible to start the printing process at early time.

In the printing apparatus according to the aspect of the invention, even when the temperature of the drying unit reaches the predetermined temperature and the temperature increase is completed, the curl correcting unit may be kept at the de-curl position as long as a printing job of instructing the printing to the printing medium is not received.

With such a configuration, even when the drying unit reaches the predetermined temperature and the temperature raising (warming-up) is completed, and when the printing job is not received, the curl correcting unit is continuously disposed at the de-curl position. For this reason, until the printing job is received and the printing is performed, it is possible to keep the drying area at the relatively high temperature.

In the printing apparatus according to the aspect of the invention, when a period until a predetermined time is elapsed is completed after the temperature of the drying unit reaches the predetermined temperature and the temperature increase is completed, the curl correcting unit may be disposed from the de-curl position to the non-de-curl position even when the printing job is not received.

With such a configuration, when the temperature of the drying unit reaches the predetermined temperature and the period until the predetermined time is elapsed is completed after the completion of the temperature raising, the curl correcting unit is disposed at the non-de-curl position from the de-curl position. For this reason, since the curl correcting unit is kept at the de-curl position, it is possible to avoid the defect such as the occurrence of indentation (contact trace) at the contact part between the transport roller and the de-curl roller.

In the printing apparatus according to the aspect of the invention, when the printing job is received after the curl correcting unit is disposed at the non-de-curl position after the period, the curl correcting unit may be disposed at the de-curl position.

With such a configuration, when the curl correcting unit is disposed at the non-de-curl position after the period and then the printing job is received, the curl correcting unit is disposed at the de-curl position. Accordingly, when the printing job is received and the next printing is started, the curl correcting unit is disposed at the de-curl position, the de-curl roller comes in contact with the transport roller, and the gap between both is suppressed to be small. For this reason, the temperature of the drying area is raised until the printing medium subjected to the printing on the basis of the printing job is transported, and is kept at the relatively high temperature. Accordingly, it is possible to perform the effective drying process on the printing medium subjected to the printing as the next printing job.

In the printing apparatus according to the aspect of the invention, even when the curl correcting unit completes the curl correction of the last printing medium in the printing job of instructing the printing to the printing medium, the curl correcting unit may be kept at the de-curl position as long as the next printing job is not received.

With such a configuration, even when the curl correcting unit completes the curl correction of the last printing medium in the printing job and as long as the next printing job is not received, the curl correcting unit is kept at the de-curl position. For this reason, until the next printing job is received and the printing is started, it is possible to keep the drying area at the relatively high temperature.

In the printing apparatus according to the aspect of the invention, in a second period until a predetermined time is elapsed after the curl correcting unit completes the curl correction of the last printing medium of the printing job, the curl correcting unit may be disposed at the de-curl position as long as the next printing job is not received, and after the second period is elapsed, the curl correcting unit may be disposed at the non-de-curl position.

With such a configuration, in the second period until the predetermined time is elapsed after the curl correction of the last printing medium of the printing job is completed, the curl correcting unit is continuously kept at the de-curl position as long as the next printing job is not received. For this reason, the drying area is kept at the relatively high temperature. Meanwhile, after the second period, the curl correction unit is disposed at the non-de-curl position. For this reason, the curl correcting unit is continuously kept at the de-curl position, and thus it is possible to avoid the defect such as the occurrence of indentation (contact trace) at the contact part between the transport roller and the de-curl roller.

In the printing apparatus according to the aspect of the invention, the curl correcting unit may be provided with a guide member that guides the printing medium between the transport roller and the de-curl roller, and the guide member may be disposed in an inclined posture such that a distance from a transport face is shorten as much as the downstream side in the transport direction.

With such a configuration, the air blown from the outlet of the drying unit remains further to the upstream side in the transport direction than the guide member in which the guide member provided in the curl correcting unit causes flow path resistance, and the drying area is formed. For this reason, the drying area is expanded to the position of the guide member on the downstream side in the transport direction. Accordingly, in the drying area, the drying of the printing medium is promoted.

BRIEF DESCRIPTION OF THE DRAWINGS

The invention will be described with reference to the accompanying drawings, wherein like numbers reference like elements.

FIG. 6 is a block diagram illustrating an electrical configuration of a printer.

DESCRIPTION OF EXEMPLARY EMBODIMENTS

Hereinafter, an ink jet printer that is a kind of printing apparatus according to an embodiment of the invention will be described with reference to FIG. 1 to FIG. 7.

Figure 1:
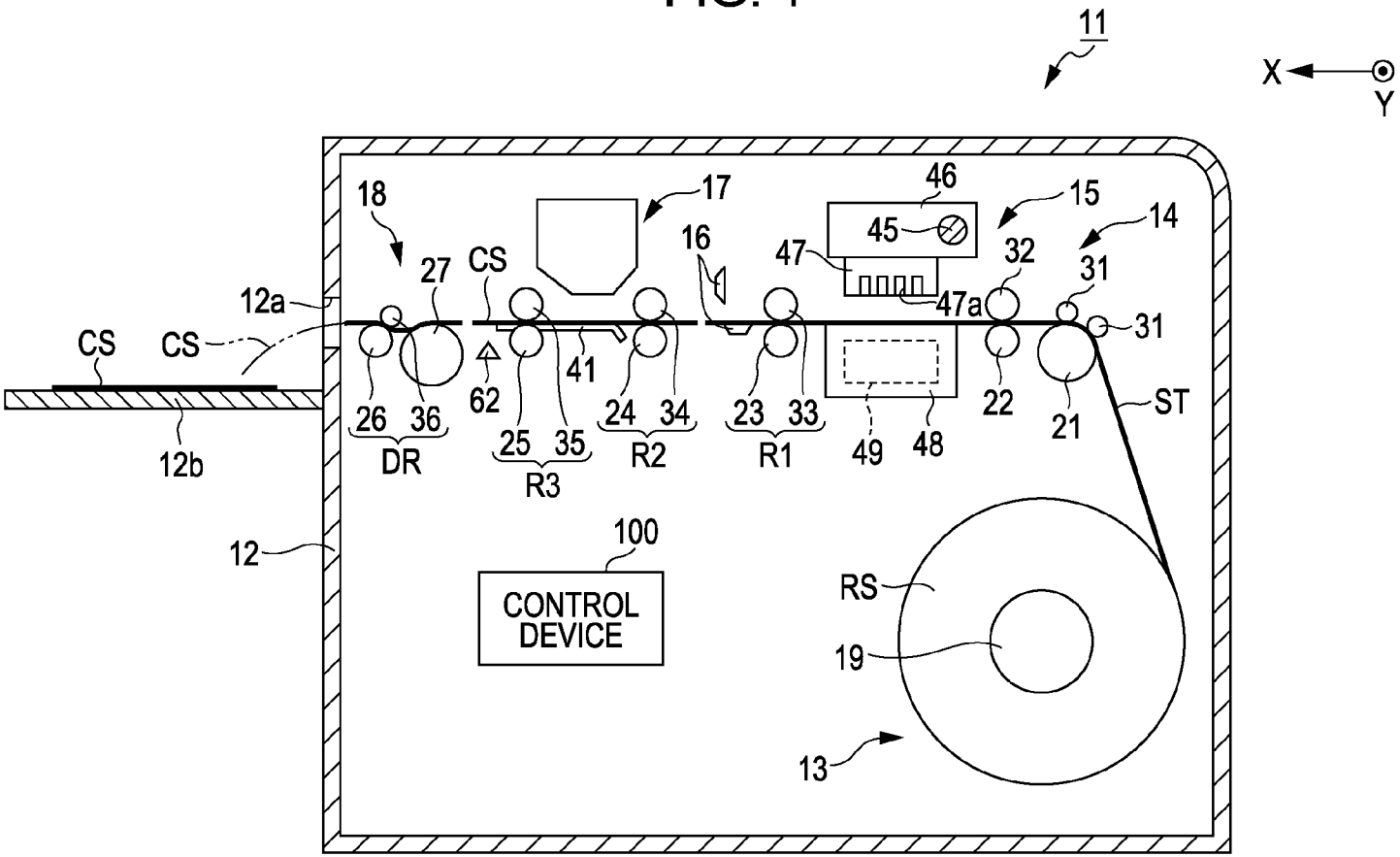
FIG. 1 is a side cross-sectional view illustrating a schematic configuration of a printer according to an embodiment.

As shown in FIG. 1, an ink jet printer (hereinafter, simply referred to as "printer 11") that is an example of the printing apparatus is provided with a body case 12 having a sheet discharge port 12*a* that is opened to a front face (a left face in FIG. 1), and a sheet discharge unit 12*b* (a discharge tray) that horizontally extends outward to carry the printed sheets CS discharged from the sheet discharge port 12*a*. The printer 11 is provided with a sheet feeding unit 13 that takes a roll body RS in which a long sheet ST (for example, a continuous sheet) is wound in a roll shape in the body case 12.

The printer 11 is provided with a transport device 14 as an example of a transport unit that transports the sheet ST along a transport path extending from the sheet feeding unit 13 to the sheet discharge unit 12*b*, in the body case 12. In the body case 12, a printing unit 15 that ejects ink droplets to the sheet ST in the course of the transport path to perform printing, and a cutter 16 that cuts the printed sheet ST by cut sheets CS (single sheets) of a predetermined length. On the downstream side of the cutter 16 in the transport direction X, a drying device 17 (a heater unit) as an example of a drying unit that ejects dry air to a printing face (a surface) of the cut sheet CS to dry the ink is provided. On the downstream side of the drying device 17 in the transport direction X, a curl correcting mechanism 18 (a de-curl mechanism) as an example of a curl correcting unit that corrects curling (a winding defect) of the cut sheet CS is provided. The curl correcting mechanism 18 has a transport function in addition to the curl correction function, and constitutes a part of the transport device 14. In the embodiment, the sheet ST and the cut sheet CS constitute an example of the printing medium.

Next, the sheet feeding unit 13 will be described. The sheet feeding unit 13 includes a rotating shaft 19 that rotatably supports the roll body RS, and a sheet feeding motor 20 (see FIG. 6) that rotates the rotating shaft 19. The rotating shaft 19 is rotated counterclockwise in FIG. 1 according to the driving of the sheet feeding motor 20, and thus the sheet ST is continuously sent from the roll body RS.

Next, the transport device 14 will be described. The transport device 14 is provided with a plurality of transport rollers (driving rollers) 21 to 27 that transport the sheets ST and CS from the upstream side to the downstream side in the transport direction X, and a driven rollers 31 to 36 capable of pinching the sheets ST and CS with the transport rollers 21 to 26, respectively. The driven rollers 31 to 36 are driven to rotate according to the driving rotation of the transport rollers 21 to 26, and thus the sheets ST and CS are transported. The curl correcting mechanism 18 configuring a part of the transport device 14 is provided with a transport roller 27 (an upstream side fixed roller) with a large diameter, and a de-curl roller pair DR (a downstream side operation roller pair) formed of a transport roller 26 and a driven roller 36 (hereinafter, referred to as "de-curl roller 36") with a small diameter disposed on the downstream side in the transport direction X of the transport roller 27. The curl correcting mechanism 18 moves the de-curl roller 36 constituting the de-curl roller pair DR to a correction position capable of applying correction force of bending it in the reverse direction to the direction of the curl during the printing, thereby performing a curl correction process on the sheet CS. The transport device 14 is provided with a transport motor 40 (see FIG. 6) that outputs dynamic force for rotating the transport rollers 21 to 27, and a transport path forming member 41 that is disposed at a position corresponding to the transport roller 25.

In the following description, the transport roller 23 and the driven roller 33 together forming a pair, are referred to as a transport roller pair R1, the transport roller 24 and the driven roller 34 are referred to as a transport roller pair R2, and the transport roller 25 and the driven roller 35 are referred to as a transport roller pair R3. In the embodiment, in at least the driven rollers 33, 34, and 35 of the rollers constituting the transport roller pairs R1, R2, and R3, rollers (for example, rollers made of sponge) having liquid repellency (for example, water repellency) are employed so as not to transfer non-dried ink adhering to the surface of the sheets ST and CS.

Next, the printing unit 15 will be described. On the transport path in the body case 12, the printing unit 15 shown in FIG. 1 is provided with a guide shaft 45 that is provided in a state of horizontally extending along a width direction Y crossing (perpendicular to) the transport direction X, and a carriage 46 that is supported by the guide shaft 45 in a state movable along the longitudinal direction (width direction Y) of the guide shaft 45. The printing head 47 is mounted on the carriage 46 in a state opposed to the transport path. The printing head 47 is provided with a plurality of nozzles 47*a* for ejecting an ink that is an example of the liquid. The carriage 46 is moved along the width direction Y (main scanning direction) while being guided to the guide shaft 45, and thus the printing head 47 is reciprocally moved in the main scanning direction with the carriage 46.

The printing unit 15 is provided with a support base 48 that is disposed at a position opposed with the transport path interposed between the printing head 47 and the support base 48. The support base 48 is provided therein with a suction mechanism 49 that suctions the sheet ST through a plurality of suction holes (not shown) communicating with the upper face thereof. The ink is ejected from the nozzle 47*a* of the printing head 47 onto the surface (the upper face in FIG. 1) of the sheet ST supported by the support base 48, and thus the recording (printing) of adhering the ink to the sheet ST is performed.

Specifically, the printer 11 receives printing job data from the host device 200 (see FIG. 6). When the printing job data is input, the control device 100 as an example of the control unit provided in the printer 11 divides the printing data included therein for each printing data corresponding to one scanning of the printing head 47. The printing head 47 performs a printing process of ejecting the ink from the nozzle 47*a* selected on the basis of the printing data while the carriage 46 is scanned. During the printing process for each scanning, the sheet ST is transported to the next printing position. That is, in the printing unit 15, the forming of a stripe-shaped image in which the width direction Y is the longitudinal direction, and the intermittent transport of the sheets ST are alternately repeated, and an image based on the printing job is formed on the sheet ST. On the transport path from the printing unit 15 to the curl correcting mechanism 18, an imaginary plane including the surface of the support base 48 and the surface of the transport path forming member 41 is a transport face of transporting the sheets ST and CS during the printing.

The cutting of the sheet ST by the cutter 16 is performed in state where the transport of the sheet ST by the transport device 14 is stopped. The cutter 16 cuts substantially the center of the sheet part between transport roller pair R1 and R2 which pinch the sheet on both sides, by an operation in the transport direction Y, and the cut sheet CS is detached from the sheet ST. In the embodiment, in the course of printing, the cutting of the sheet ST is performed at the timing the transport of the sheet ST is stopped.

At a position that is further to the downstream side in the transport direction X than the cutter 16, the drying device 17 that performs a drying process on the cut sheet CS (hereinafter, simply referred to as "sheet CS") to which the ink is adhered by the printing process is provided. The drying device 17 blows a warm air (dry air) onto the surface (printing face) of the sheet CS to perform a drying process of drying the ink on the sheet CS. The drying device 17 performs a temperature control and an air blow control by the control device 100.

Next, the drying device 17 will be described in detail with reference to FIG. 2. The drying device 17 is disposed at an upper position of the area interposed between the transport roller pair R2 and R3 in the transport direction X. The drying device 17 has a length corresponding to the maximum width of the sheet CS in the width direction Y, and blows the warm air to the whole area of the sheet CS in the width direction Y.

Figure 2:
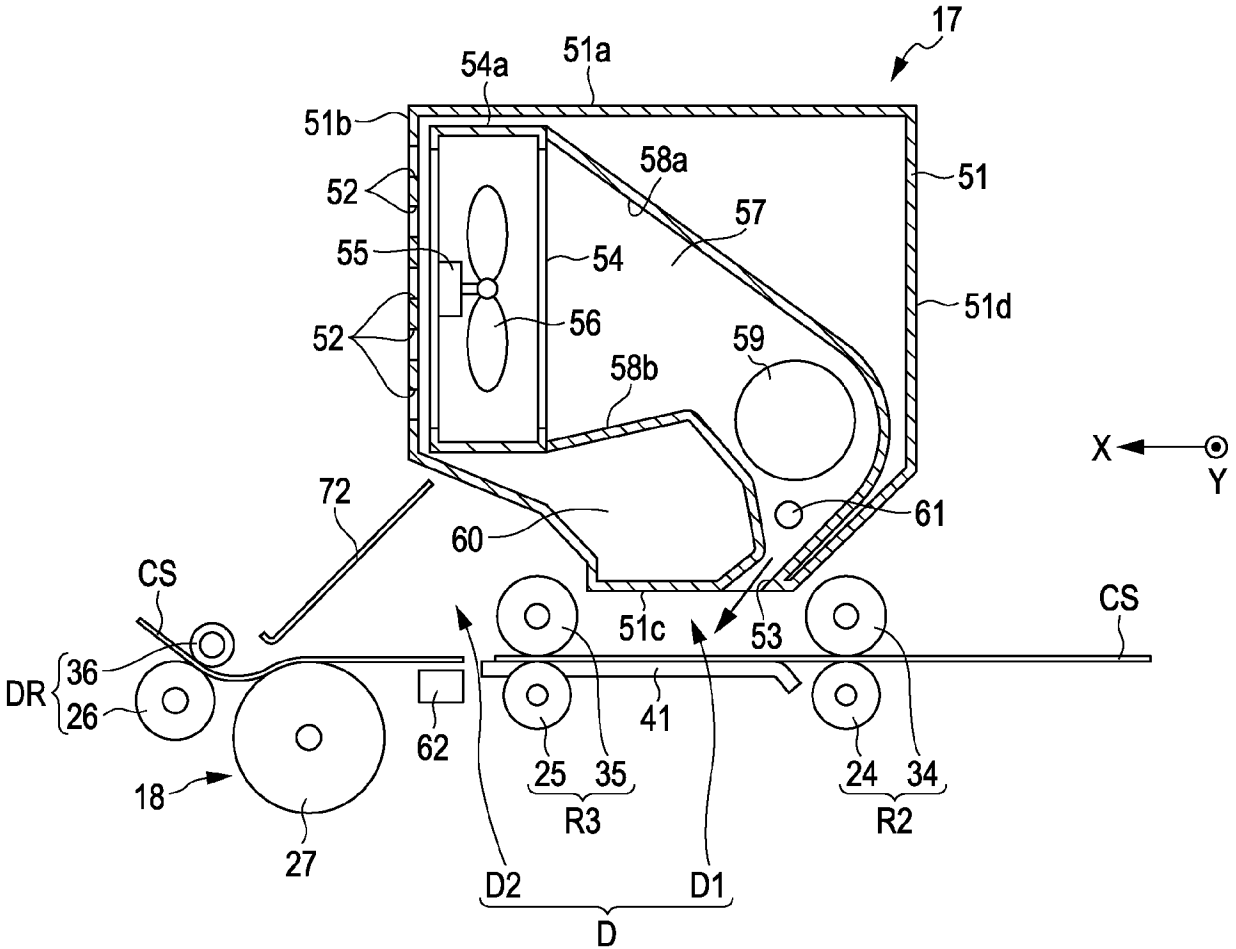
FIG. 2 is a schematic side cross-section view illustrating a drying device and a peripheral configuration thereof.

As shown in FIG. 2, the drying device 17 has a cover 51 having substantially a rectangular shape. The cover 51 has an upper face portion 51*a*, a rear side face portion 51*b*, a lower face portion 51*c*, a front side face portion 51*d*, and left and right side face portions (not shown) opposed in the width direction Y. On the rear side face portion 51*b* of the cover 51 on the downstream side in the transport direction, a plurality of (five in FIG. 2) air inlets 52 are formed regularly at a predetermined distance in the vertical direction. At the lower face portion 51*c* of the cover 51, the outlet 53 that blows the warm air toward the surface of the sheet CS is formed at the position on the upstream side in the transport direction (close to the right in FIG. 2). The outlet 53 is opened substantially in the rectangular shape extending with a length over the whole area in the width direction of the sheet CS along the longitudinal direction (width direction Y) of the cover 51, and blows the warm air to the obliquely lower portion directed to the downstream side in the transport direction X.

At the position opposed to the air inlets 52 in the cover 51, a plurality of (only one in FIG. 2) fan units 54 are provided. The fan unit 54 includes a rectangular box-shaped fan case 54*a* in which the front portion and the rear portion thereof partially communicate with each other, a fan motor 55 that is provided in the fan case 54*a*, and a fan 56 that is fixed to the output shaft of the fan motor 55. In the cover 51, an air flow path portion 57 for leading the air taken in the cover 51 from the air inlet 52 to the outlet 53 by the fan unit 54 is provided. In the cover 51, the rear end portions (left end portions in FIG. 2) of the inner wall faces 58*a* and 58*b* formed substantially in a J shape are connected to the upper face portion and the lower face portion of the fan case 54*a*, respectively, and the end portion (lower right end portion in FIG. 2) of the front lower side is connected to front and rear both sides with the outlet 53 interposed therebetween with respect to the lower face portion 51*c*. The air flow path portion 57 is partitioned and formed by the inner wall faces 58*a* and 58*b* and the left and right side face portions (not shown) of the cover 51.

In the air flow path portion 57, a heater 59 is provided at a position between the fan 56 and the outlet 53 in the air flow direction. The leading edge portion of the air flow path portion 57 on the outlet 53 side is inclined toward the downstream side in the transport direction X by the outlet 53. Accordingly, the drying device 17 blows the air (warm air) taken from the air inlet 52 and heated by the heater 59, to the obliquely lower portion directed from the outlet 53 to the downstream side in the transport direction X, by the rotation of the fan 56 in a state where the heater 59 emits the heat. At the position further to the downstream side of the air flow direction than the heater 59 in the air flow path portion 57, a temperature sensor 61 that detects a temperature of the air is provided. The heating of the heater 59 is controlled by the control device 100 such that the detection temperature of the temperature sensor 61 is a set temperature (a target temperature).

As shown in FIG. 2, the lower face portion 51*c* of the cover 51 of the drying device 17 is substantially a horizontal face opposed at a predetermined distance to the upper face (transport face) of the transport path forming member 41. The warm air (dry air) blown from the outlet 53 to the surface (printing face) of the sheet CS remains in the area surrounded by the surface of the sheet CS, the lower face portion 51*c* of the cover 51, and the driven rollers 34 and 35, thereby forming a first drying area D1. That is, the bottom face of the first drying area D1 is formed by the sheet CS (or the transport path forming member 41), and the top face of the first drying area D1 is formed by the lower face portion 51*c* of the cover 51. The upstream end face and the downstream end face in the transport direction X of the first drying area D1 are formed by the driven rollers 34 and 35.

In the cover 51 of the drying device 17, a heat storage space portion 60 is partitioned and formed between the air flow path portion 57 and the lower face portion 51*c*. When the air in the heat storage space portion 60 is warmed once, the heat radiation of the air in the air flow path portion 57 adjacent to the heat storage space portion 60 and the air remaining in the first drying area D1 is relatively suppressed.

As shown in FIG. 2, at a position slightly further away to the downstream side in the transport direction X than the transport roller pair R3, a sensor 62 (a sheet end detecting sensor) that detects the leading edge and the trailing edge of the sheet CS in the transport direction X is provided. For example, the sensor 62 is disposed at the lower portion position than the upper face (transport face) of the transport path forming member 41, and detects the leading edge and the trailing edge from the lower side of the sheet CS. In the embodiment, the sensor 62 is a reflective optical sensor electrically connected to the control device 100, and has a light source unit (a light emitting element) and a light receiving unit (a light receiving element) (not shown).

The light receiving unit receives the reflected light of the light (detection light) output upward perpendicular to the transport face, and thus the sensor 62 outputs an electrical signal corresponding to the intensity of the reflected light to the control device 100. For example, the sensor 62 outputs an ON value larger than a predetermined threshold value when the sheet CS is a reflection target, and outputs an OFF value equal to or smaller than the threshold value when the sheet CS is not the reflection target. Accordingly, the output value of the sensor 62 is changed from the OFF value to the ON value, and the leading edge of the sheet CS is detected. The output value of the sensor 62 is changed from the ON value to the OFF value, and the trailing edge of the sheet CS is detected.

The curl correcting mechanism 18 is provided at the further downstream side position in the transport direction X than the sensor 62. The curl correcting mechanism 18 includes a transport roller 27 (a support roller) with a relatively large diameter, and a de-curl roller pair DR (an operation roller pair) that is positioned on the slightly further downstream side in the transport direction X than the transport roller 27. The curl correcting mechanism 18 is provided with a de-curl plate 72 as an example of the guide member that guides the leading edge portion of the sheet CS to the gap of the de-curl roller pair DR.

Figure 3:
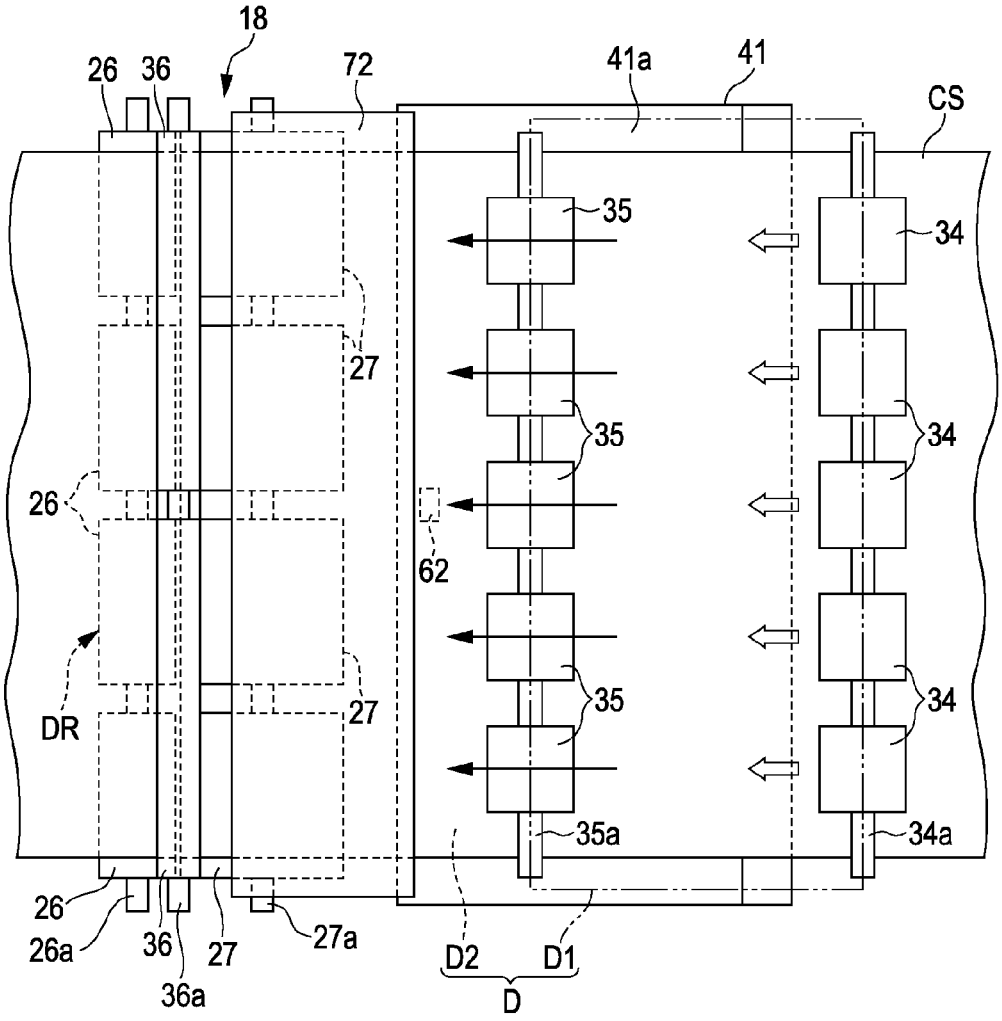
FIG. 3 is a schematic plan view illustrating a drying area.

The de-curl plate 72 of the embodiment is disposed in a posture inclined in a direction of shortening the distance from the transport face by the downstream side in the transport direction X. As shown in FIG. 3, the de-curl plate 72 has a width slightly longer than the width of the sheet CS in the width direction.

As shown in FIG. 2 and FIG. 3, the warm air (black thick line arrows shown in FIG. 3) blown from the outlet 53 to the sheet CS remains between the driven rollers 34 and 35 to form a first drying area D1. The downstream end in the transport direction X of the first drying area D1 is only intermittently covered with a plurality of driven rollers 35, a part of the air remaining in the first drying area D1 leaks on the downstream side in the transport direction X on the path (solid line arrows shown in FIG. 3) passing through the upper gap of the driven roller 35 and the path passing through the gap between the driven rollers 35. The de-curl plate 72 allows the warm air leaked from the first drying area D1 to the downstream side in the transport direction X to remain between the de-curl plate 72 and the driven roller 35, to form the second drying area D2. For this reason, the whole of the drying area D including the drying areas D1 and D2 is substantially expanded on the downstream side in the transport direction X.

The de-curl roller 36 is moved to the correction position shown in FIG. 2, the curl correcting mechanism 18 pinches the sheet CS with the de-curl roller pair DR, and forms a curved portion curved in a predetermined curvature in the opposite direction to the curl at the sheet portion between the pinching position and the transport roller 27.

The control device 100 operates the curl correcting mechanism 18 to the correction position at the timing of inserting the detected leading edge into the gap of the de-curl roller pair DR on the basis of the detection signal (leading edge detection signal) of detecting the leading edge of the sheet CS by the sensor 62. The control device 100 returns the curl correcting mechanism 18 to the waiting position at the timing just after the detected trailing edge passes through the de-curl roller pair DR on the basis of the detection signal (trailing edge detection signal) of detecting the trailing edge of the sheet CS by the sensor 62.

Figure 4A:
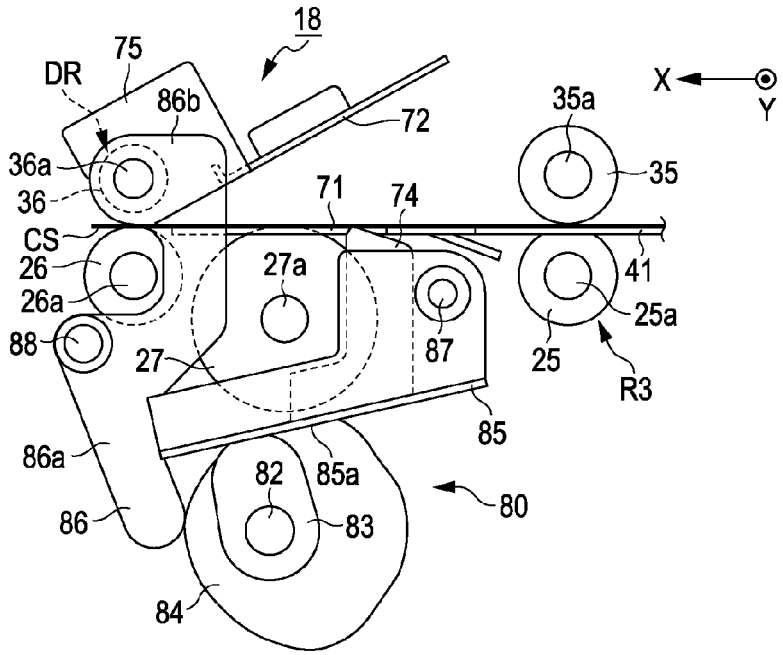
FIG. 4A and FIG. 4B are side views illustrating a configuration of a curl correcting mechanism and an operation thereof.
Figure 4B:
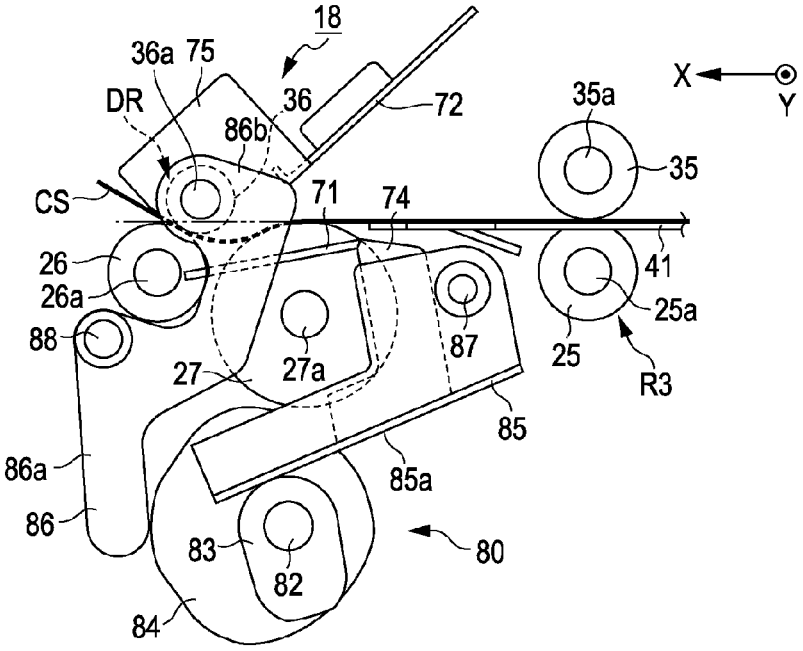

Next, the detail configuration of the curl correcting mechanism 18 will be described with reference to FIG. 4A and FIG. 4B. FIG. 4A shows that the curl correcting mechanism is disposed at the waiting position, and FIG. 4B shows that the curl correcting mechanism is disposed at the correction position.

The curl correcting mechanism 18 includes the transport roller 27 with a large diameter that is supported by the shaft portion 27*a* extending in the width direction Y, and the de-curl roller pair DR formed of the transport roller 26 with a small diameter and the de-curl roller 36 supported by the shaft portions 26*a* and 36*a* extending in the width direction Y. When the de-curl roller 36 is at the waiting position, the separation distance between the de-curl roller 36 and the transport roller 26 is longer than the thickness of the sheet CS, and the sheet CS is transported to the downstream side (left side in FIG. 4A) on the transport path shown in FIG. 4A by the transport roller 26 without being pinched by the de-curl roller 36.

The curl correcting mechanism 18 is provided with a lower guide plate 71 for guiding the sheet CS to the gap of the de-curl roller pair DR, and an upper de-curl plate 72. The lower guide plate 71 is formed in a comb-teeth shape in which a plurality of portions extend to be disposed at each gap between the plurality of transport rollers 27 from the support portion 74 toward the downstream side in the transport direction. The upper face is substantially flush with the upper face 41*a* of the transport path forming member (see FIG. 4A and FIG. 4B) at the guide position (FIG. 4A), and the comb-teeth shape guide plate 71 forms the transport face of the sheet CS. The guide plate 71 is evacuated to the lower portion so as not to disturb the curl correction process at the evacuation position (FIG. 4B). The guide plate 71 guides the back face side of the sheet CS transported by the transport roller 27, and the de-curl plate 72 guides the front face side of the sheet CS to guide the leading edge portion of the sheet CS to the gap of the de-curl roller pair DR.

The curl correcting mechanism 18 includes a cam motor 73 (see FIG. 6) that is a dynamic power source of operating the de-curl roller 36 and the guide plate 71 between the waiting position and the correction position, and a cam mechanism 80 that transfers the dynamic power of the cam motor 73 to the de-curl roller 36 and the guide plate 71.

As shown in FIG. 4A and FIG. 4B, the cam mechanism 80 includes a cam shaft 82 that is rotated by the dynamic power of the cam motor 73 (see FIG. 6), cam members 83 and 84 that are rotated by the rotation of the cam shaft 82, and levers 85 and 86 that are driven by the rotation of the cam members 83 and 84. The guide plate 71 is supported by the front end portion (upper end portion) of the support portion 74 fixed to the side face of the lever 85. The lever 85 has an extension portion 85*a* extending the oblique lower portion toward the downstream side in the transport direction X, and the cam member 83 is engaged with the end face (a cam follower face) (lower face in FIG. 4A and FIG. 4B) of the extension portion 85*a*. The lever 85 is urged counterclockwise in FIG. 4A and FIG. 4B by an urging member (for example, a torsion coil spring) (not shown), and the cam member 83 and the lever 85 are disposed at the swing position of the waiting time shown in FIG. 4A at the normal time.

The lever 86 is swung about the swing shaft 88. The lever 86 has an extension portion 86*a* extending from the swing shaft 88 to the lower portion, and the cam member 84 is engaged with the end portion (cam follower face) of the extension portion 86*a*. The shaft portion 36*a* of the de-curl roller 36 is rotatably supported at the leading edge portion of the support portion 86*b* extending upward from the swing shaft 88 with respect to the lever 86. The lever 86 is urged in the counterclockwise direction in FIG. 4A and FIG. 4B by the urging force of the urging member (for example, a torsion coil spring) (not shown), and the cam member 84 and the lever 86 are disposed at the swing position at the waiting time shown in FIG. 4A. Each one pair of the cam members 83 and 84 and the levers 85 and 86 are provided both end portions in the axial direction of the cam shaft 82 having an axial length longer than the width of the sheet CS.

When the cam shaft 82 is rotated by about 180° from the waiting position shown in FIG. 4A according to the driving of the cam motor 73, and the lever 85 is swung counterclockwise in FIG. 4A according to the rotation of the cam members 83 and 84, the lever 86 is swung clockwise in FIG. 4A, and is disposed at the swing position at the correcting time shown in FIG. 4B. As a result, the position of the guide plate 71 is changed from the guide position (FIG. 4A) of forming the transport face to the evacuation position (FIG. 4B) of evacuating from the transport face to the lower portion. The position of the de-curl roller 36 is changed on the arc-shaped path clockwise (upstream side direction in the transport direction X) about the swing shaft 88, the sheet CS is pinched with the transport roller 26 during the change in position, and it is disposed at the correction position shown in FIG. 4B of curving the curl by curving the sheet portion between the pinching position and the transport roller 27 in the reverse direction to the curl.

The cam shaft 82 is rotated by about 180° from the waiting state shown in FIG. 4B according to the driving of the cam motor 73, the lever 85 is swung clockwise in FIG. 4B, and the lever 86 is swung counterclockwise in FIG. 4B, according to the rotation of the cam members 83 and 84. As a result, the de-curl roller 36 returns from the correction position shown in FIG. 4B to the waiting position shown in FIG. 4A, and the guide plate 71 returns from the evacuation position shown in FIG. 4B to the guide position shown in FIG. 4A.

In the embodiment, during the preliminary heating operation (warming-up) started to raise the temperature of the drying device 17 to a set temperature (a predetermined temperature) just after supplying the power of the printer 11, the curl correcting mechanism 18 is disposed at the correction position, to shorten the time (warming-up time) necessary for raising the temperature to the set temperature of the drying device 17.

Figure 5A:
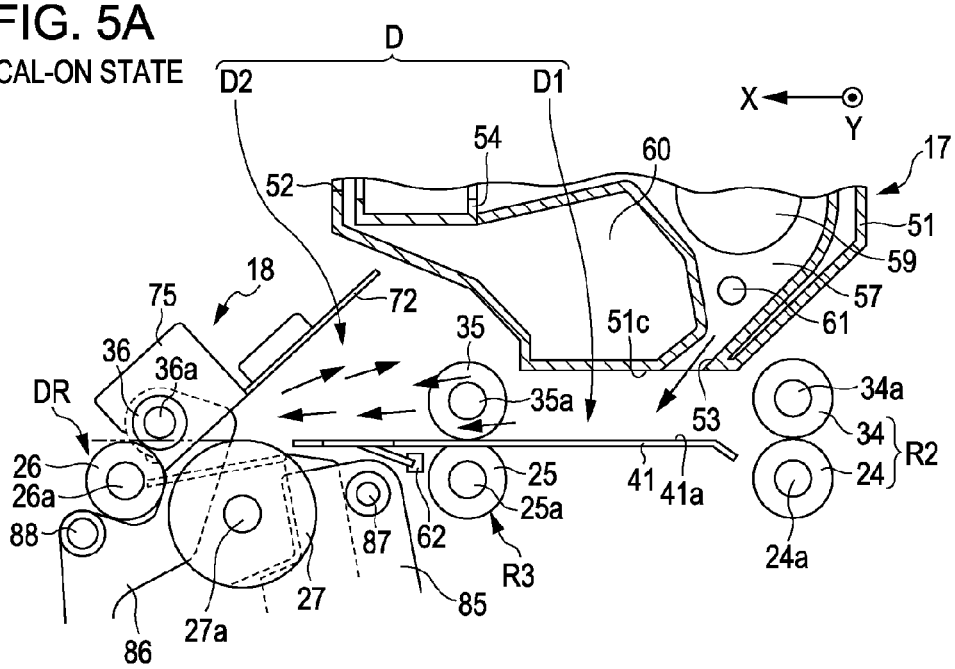
FIG. 5A is a partially exploded side view illustrating a drying area periphery in a de-curl ON state.
Figure 5B:
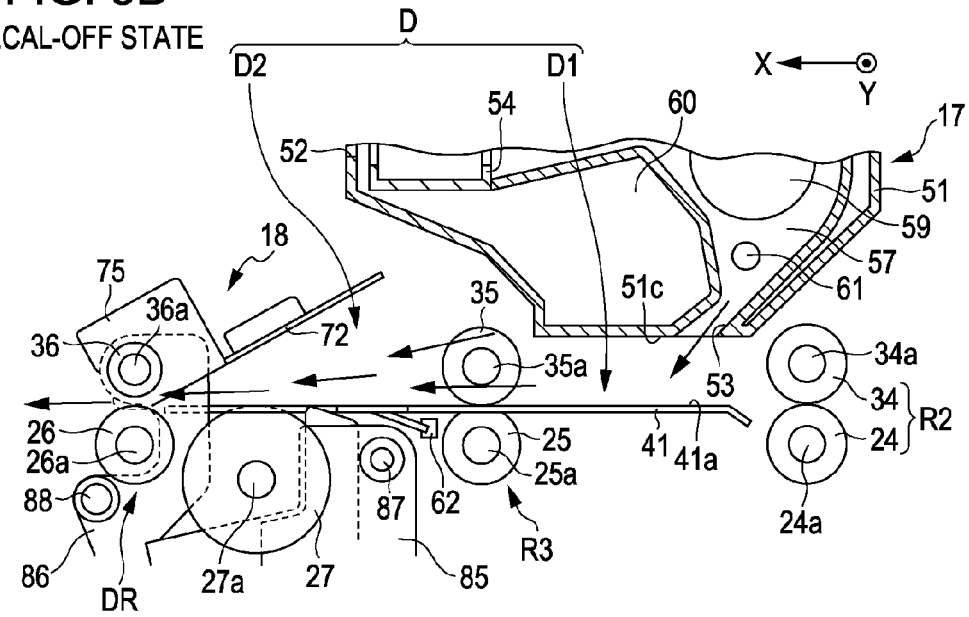
FIG. 5B is a partially exploded side view illustrating a drying area periphery in a de-curl OFF state.

In the specification, for example, as shown in FIG. 4A and FIG. 5B, in the curl correcting mechanism 18, an operation of disposing the de-curl roller 36 at the waiting position where the correction of the curl is not performed is called "de-curl OFF", and the state where the de-curl roller 36 is at the waiting position is called "de-curl OFF state". As shown in FIG. 4B and FIG. 5A, in the curl correcting mechanism 18, the operation of disposing the de-curl roller 36 at the correction position capable of performing the correction of the curl is called "de-curl ON", and the state where the de-curl roller 36 is at the correction position is called "de-curl ON state".

In the related art, in the preliminary heating operation (warming-up) in which the curl operation is not performed, the curl correcting mechanism 18 is disposed at the waiting position. In the related art, even in the waiting state where the preliminary heating is completed and the printing can be performed, at the time point when the leading edge of the sheet CS subjected to the printing reaches the de-curl roller pair DR through the drying area D, the curl correcting mechanism 18 is operated (de-curl ON) at the correction position from the waiting position for the first time. During the raising of the temperature to the set temperature of the drying device 17, when the curl correcting mechanism 18 is disposed at the waiting position, as shown in FIG. 5B, the warm air flowing on the downstream side in the transport direction X through the gap of the driven roller 35 from the drying area D flows to the downstream side in the transport direction X in which the gap between one pair of rollers 26 and 36 constituting the de-curl roller pair DR as the flow path, and is discharged to the outside of the body case 12. In this case, under the preliminary heating driving, the time is necessary to raise the temperature of the drying area D to a proper temperature.

In the embodiment, during the preliminary heating operation (warming-up) after supplying the power of the printer 11, as shown in FIG. 5A, the curl correcting mechanism 18 is disposed at the correction position (de-curl ON). In the de-curl ON state shown in FIG. 5A, the de-curl roller 36 disposed at the correction position comes in contact with the transport roller 26, and thus the gap (flow path) between the rollers 26 and 36 is substantially blocked. For this reason, as shown in FIG. 5A by the arrow, even when a part of the air starts flowing from the drying area D to the downstream side in the transport direction X, the air easily remains further to the upstream side in the transport direction X than the de-curl roller pair DR, and it is possible to suppress the flow amount of the warm air discharged to the outside of the printer 11 to be small.

Next, an electrical configuration of the printer 11 will be described with reference to FIG. 6. As shown in FIG. 6, the printer 11 is communicably connected to the host device 200, and receives the printing job data from the host device 200. The printing job data received from the host device 200 by the printer 11 is input to the control device 100. The control device 100 includes a computer 101, a head driving circuit 102, motor driving circuits 103 to 106, and a heater driving circuit 107. The computer 101 is electrically connected to the head driving circuit 102, the motor driving circuits 103 to 106, and the heater driving circuit 107.

The printer 11 is provided with a power supply switch 11*a*. When the printer 11 is powered off and the power supply switch 11*a* is operated, the printer 11 is powered on. When the printer 11 is powered on and the power supply switch 11*a* is operated, the printer 11 is powered off. The printer 11 is provided with an operation panel having a display unit and an operation unit, and the power supply switch 11*a* is provided as one switch of the operation unit.

Figure 7:
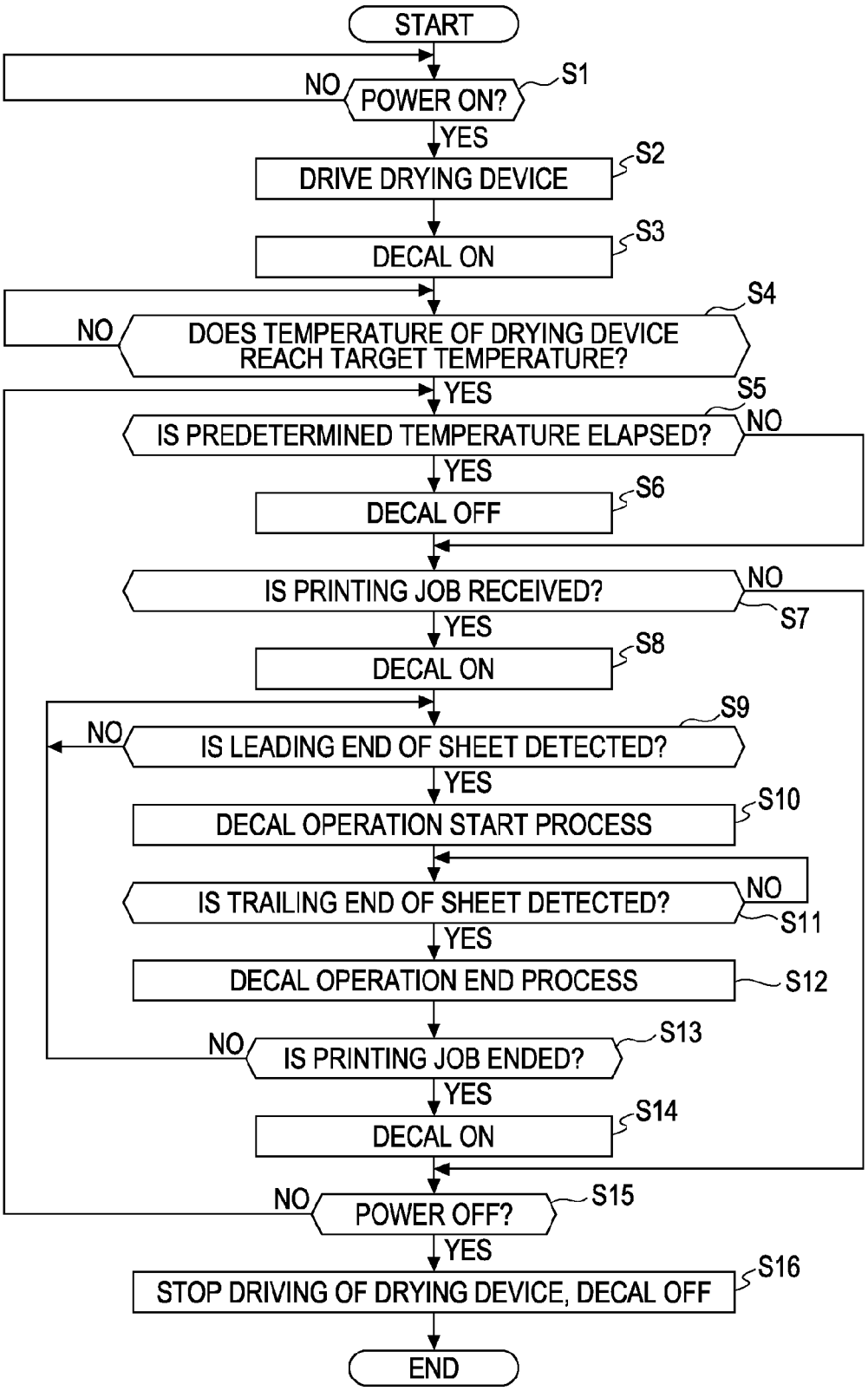
FIG. 7 is a flowchart illustrating a drying control process.

The computer 101 is provided with an ASIC 109 (Application Specific IC), a CPU 110, a ROM 111, a RAM 112, and a nonvolatile memory 113. In the ROM 111, various control programs and various setting data are stored. In the nonvolatile memory 113, various programs such as a firmware program, and various setting data necessary for a printing control are stored. In the embodiment, in the nonvolatile memory 113, a drying control processing program shown in the flowchart of FIG. 7 is stored. In the RAM 112, program data executed by the CPU 110, various setting data, various data that are an operation result and a process result of the CPU 110, and various data processed by the ASIC 109 are temporarily stored.

The CPU 110 executes the program stored in the ROM 111 or the nonvolatile memory 113, and thus the computer 101 performs various controls. For example, the computer 101 controls the printing head 47 through the head driving circuit 102, and controls the driving of the sheet feeding motor 20, the transport motor 40, the cam motor 73, and the fan motor 55 through the motor driving circuits 103 to 106.

The computer 101 drives the sheet feeding motor 20 through the motor driving circuit 103 to feed the sheet ST from the roll body RS (see FIG. 1), and drives the transport motor 40 through the motor driving circuit 104 to transport the fed sheet ST by the rotation of the transport rollers 21 to 27.

The computer 101 is connected to a rotary encoder 67 that outputs a pulse signal with a pulse number proportional to the rotation amount of the transport motor 40 constituting the transport device 14. When the leading edge of the sheet ST is detected further to the upstream side in the transport direction X than the printing unit 15 by a sensor (not shown), the computer 101 counts the number of pulses of the pulse signal input from the rotary encoder 67 on the basis of the detection position, and recognizes the transport positions of the sheets ST and CS from the count value. The computer 101 also detects the direction of transporting the sheet corresponding to the transport speed proportional to the rotation speed of the transport motor 40 and the rotation direction of the transport motor 40 on the basis of the pulse signal from the rotary encoder 67.

As shown in FIG. 6, the output shaft of the transport motor 40 is connected to the dynamic power transfer and conversion device 68. The dynamic power transfer and conversion device 68 switches a transfer destination of the dynamic power between the transport motor 40 and the transport rollers 21 to 27 according to the transport process of the sheet ST. The sheet transport speed is slightly high after cutting than before cutting by the cutter 16 by a deceleration mechanism interposed between the dynamic power transfer and conversion device 68 and the transport rollers 21 to 27, and each sheet CS after cutting is transported at some interval. The rotary encoder 67 may detect the rotation of the dynamic power transfer system of the dynamic power transfer and conversion device 68 or the rotation of the shaft portions of the transport rollers 21 to 27 in the range in which it is possible to detect the transport position of the sheet ST.

The computer 101 controls an electric current flowing in the heater 59 through the heater driving circuit 107 such that the detection temperature of the temperature sensor 61 is the target temperature (set temperature), to control the temperature of the warm air blown from the outlet 53 of the drying device 17. The computer 101 controls the driving of the fan motor 55 through the motor driving circuit 106 such that the rotation speed of the fan 56 is the set speed, to control the flow amount of the warm air blown from the outlet 53.

The computer 101 controls the driving of the cam motor 73 on the basis of the process result of the drying control process shown in FIG. 7, and causes the de-curl ON to dispose the curl correcting mechanism 18 at the correction position at the warming-up time of the drying device 17 started after supplying the power. The computer 101 is basically in the de-curl ON except when the curl correcting mechanism 18 performs the curl correction of the sheet CS even after the warming-up of the drying device 17 is completed to be the waiting state. However, when the de-curl ON state is kept for a long time, an indentation occurs in the rollers 26 and 36 due to the contact pressure between the rollers 26 and 36. For this reason, when the printer 11 does not receive the printing job in the waiting state and the de-curl ON state continues for a regular time (a predetermined time), that is, when the predetermined time is elapsed after being the de-curl ON state, it is de-curl OFF.

When the leading edge of the sheet CS is detected by the change of the signal input from the sensor 62 from the OFF value to the ON value, the computer 101 drives the cam motor 73 by the rotation amount corresponding to about 180° of the cam shaft 82 at the timing when the leading edge is inserted into the gap of the de-curl roller pair DR. The curl correcting mechanism 18 is operated from the waiting position (FIG. 4A) to the correction position (FIG. 4B) by the driving of the cam motor 73. When the trailing edge of the sheet CS is detected by the change of the signal input from the sensor 62 from the ON value to the OFF value, the computer 101 drives the cam motor 73 by the rotation amount corresponding to about 180° of the cam shaft 82 at the timing when the trailing edge passes through the gap of the de-curl roller pair DR. The curl correcting mechanism 18 is returned from the correction position (FIG. 4B) to the waiting position (FIG. 4A) by the driving of the cam motor 73.

Specifically, the timing of controlling the curl correcting mechanism 18 is as follows. When the sensor 62 detects the leading edge of the sheet CS, the computer 101 counts the number of pulses of the pulse signal from the rotary encoder 67, and cause the curl correcting mechanism 18 to be the de-curl ON at the timing when the transport distance based on the count value reaches the first set distance for the correction operation start. When the sensor 62 detects the trailing edge of the sheet CS, the number of pulses of the pulse signal from the rotary encoder 67 is counted, the curl correcting mechanism 18 is caused to be the de-curl OFF at the timing when the transport distance based on the count value reaches the second set distance for the returning operation.

On the left side in FIG. 6, functional blocks constructed by the CPU 110 executing the drying control processing program shown in FIG. 7 stored in the nonvolatile memory 113 are shown. The CPU 110 executes the program to construct a main control unit 121, a temperature control unit 122, a de-curl control unit 123, a count unit 124, a first determination unit 125, a second determination unit 126, a third determination unit 127, and a fourth determination unit 128, in the computer 101. Of course, the units 121 to 128 are not limited to a software configuration constructed by the execution of the program by the CPU 110, for example, may be a hardware configuration based on electronic circuits such as integrated circuits provided in the computer 101. In addition, a part thereof may be configured by software, and the other part thereof may be configured by hardware.

The printing job data received from the host device 200 by the printer 11 include a printing command, and printing image data for one or more copies. The computer 101 analyzes the printing command. For example, when it is printing of the plurality of copies, the computer 101 performs a printing control of sequentially printing an image based on the printing image data for each copy.

Next, functional portions shown in FIG. 6 constructed by the computer 101 executing the drying control processing program (FIG. 7) will be described.

The main control unit 121 generally controls a printing system (a recording system and a transport system), a cutting system, a drying system, and a curl correcting system.

The temperature control unit 122 performs a temperature control of the drying device 17. That is, when the printer 11 is powered on, the temperature control unit 122 instructs the motor driving circuit 106 to drive the fan motor 55, and instructs the heater driving circuit 107 to change ON and OFF of the heater 59 and a current value flowing at the ON time. The temperature control unit 122 controls the current value flowing in the heater 59 according to the temperature raising program stored in advance in the nonvolatile memory 113 with reference to the detection temperature of the temperature sensor 61, and performs the temperature control until the temperature reaches the target temperature (set temperature) by a temperature raising profile based on the temperature raising program. After the drying device 17 reaches the target temperature, the temperature control unit 122 performs a feedback control of the current value flowing in the heater 59 on the basis of the detection temperature of the temperature sensor 61 to keep the warm air in the drying device 17 at the target temperature.

The de-curl control unit 123 controls the curl correcting mechanism 18. Specifically, when the curl correcting mechanism 18 is disposed at the correction position, the de-curl control unit 123 outputs the de-curl ON instruction to the motor driving circuit 105. When the curl correcting mechanism 18 is disposed at the waiting position, the de-curl control unit 123 outputs the de-curl OFF instruction to the motor driving circuit 105. When the motor driving circuit 105 receives the de-curl ON instruction, the motor driving circuit 105 rotates the cam motor 73 from the first rotation position at the waiting position time to the second rotation position at the correction position time. As a result, the de-curl roller 36 is disposed at the de-curl position capable of pinching the sheet CS with the transport roller 26, and the curl correcting mechanism 18 is in the de-curl ON state. When the motor driving circuit 105 receives the de-curl OFF instruction, the motor driving circuit 105 rotates the cam motor 73 from the second position at the correction position time to the first rotation position at the waiting position time. As a result, the de-curl roller 36 is disposed at the non-de-curl position separated from the transport roller 26, and the curl correcting mechanism 18 is in the de-curl OFF state.

The count unit 124 counts the elapsed time after the drying device 17 reaches the target temperature, by the heating at the preliminary heating operation (warming-up). When the curl correction process of the last sheet CS in the printing job is completed and then is de-curl ON, the count unit 124 counts the elapsed time after the de-curl ON.

The first determination unit 125 determines whether or not the power is ON. When the user operates the power supply switch 11*a* in the printer 11 in the power OFF state, the operation signal is input to the computer 101. When the operation signal is input in the power OFF state of the printer 11, the first determination unit 125 determines that it is powered on. The first determination unit 125 determines whether or not it is powered off. That is, when the operation signal is input in the power ON state of the printer 11, the first determination unit 125 determines that it is powered off.

The second determination unit 126 determines whether or not the temperature of the drying device 17 during the warming-up reaches the target temperature. That is, the second determination unit 126 determines whether or not the detection temperature of the temperature sensor 61 during the warming-up reaches the target temperature.

The third determination unit 127 determines whether or not a predetermined time is elapsed after the temperature of the drying device 17 reaches the target temperature until the first printing job is received after the completion of the warming-up. That is, the third determination unit 127 determines whether or not the elapsed time when the count unit 124 starts counting reaches a predetermined time after it is determined that the temperature of the drying device 17 reaches the target temperature by the second determination unit 126. In other words, the third determination unit 127 determines whether or not the period until a predetermined time is elapsed after the temperature of the drying device 17 reaches the target temperature is completed.

The third determination unit 127 determines whether or not a predetermined time is elapsed after the de-curl ON after the curl correction process of the last sheet CS in the printing job is completed. That is, when it is the de-curl ON just after the curl correction of the last sheets CS in the printing job is completed, the third determination unit 127 determines whether or not the elapsed time when the count unit 124 starts counting reaches a predetermined time when it is the de-curl ON. In other words, the third determination unit 127 determines whether or not the second period in which a predetermined time is elapsed after the curl correction of the last sheet CS in the printing job is completed is expired. When printing job is not received and the printing will not be started, the third determination unit 127 determines whether or not it is the period to the de-curl OFF to prevent indentation from occurring in the rollers 26 and 36 in the de-curl ON state, and thus determines whether or not the de-curl ON state is kept for a predetermined time. The predetermined time after the completion of the warming-up and the predetermined time after the completion of the curl correction of the last sheet CS in the printing job are set to different values in the embodiment, but may be set to the same value.

The fourth determination unit 128 determines whether or not the printing job is completed. That is, when the printing job is the printing of a plurality of copies, the fourth determination unit 128 determines whether or not the printing job is completed whenever the curl correction process of the sheet CS is completed. In the embodiment, when the curl correction of the last sheet CS in the printing job is completed, the curl correcting mechanism 18 causes the curl correcting mechanism 18 to be the de-curl ON to keep the drying area D warm. The fourth determination unit 128 determines whether or not all the printing jobs are completed up to the curl correction, thereby determining whether or not to be the de-curl ON. The fourth determination unit 128 also determines whether or not the printing job is received.

Operation

Next, an operation of the printing 11 of the embodiment will be described with reference to FIG. 5A, FIG. 5B, and FIG. 7.

When the printer 11 is powered on, the control device 100 starts the electrical connection of the heater 59 and driving the fan motor 55, and the warm air (dry air) is blown from the outlet 53 of the drying device 17. When the detection temperature of the temperature sensor 61 reaches the set temperature, the printer 11 completes the preliminary heating operation (warming-up), and is in the waiting state in which it is possible to perform the printing.

During the warming-up, the first drying area D1 is formed between the driven rollers 34 and 36, the air leaked from the driven roller 35 forming the downstream end in the transport direction of the first drying area D1 remains further to the upstream side than the de-curl plate 72, and thus the second drying area D2 is formed. Accordingly, the relatively wide drying area D (D1+D2) is formed in the transport direction X. In the waiting state after the warming-up, the drying area D is at a temperature suitable for drying the ink on the sheet CS.

When the printing job data is received from the host device 200, the computer 101 in the control device 100 performs a printing process based on the printing job data. The transport of the sheet ST by driving the sheet feeding motor 20 and the transport motor 40, and the scanning of the carriage 46 in the width direction Y by driving a carriage motor (not shown) are alternately performed. The printing head 47 ejects the ink from the nozzle 47*a* selected on the basis of the printing data during the scanning of the carriage 46, and the image based on the printing job is printed on the surface of the sheet ST. The ink-adhered sheet ST subjected to the printing of the image is cut to the sheet CS for each image by the cutter 16, when the cutting position reaches the cutter 16.

The sheet CS on which the ink is in the non-dried state is transported to the drying area D formed under the drying device 17. First, in the first drying area D1, the warm air is ejected from the outlet 53 toward the surface of the sheet CS. For this reason, the ink adhering to the surface of the sheet CS is dried by the heat of the air remaining in the first drying area D1 and the flux of the warm air (air current) blown to the surface of the sheet CS. In the second drying area D2, the ink adhering to the surface of the sheet CS is dried mainly by the heat of the air remaining in the second drying area D2.

Hereinafter, the drying control process performed by the computer 101 controlling the curl correcting mechanism 18 will be described. The computer 101 performs the drying control process shown in the flowchart of FIG. 7. The drying control process is performed when the printer 11 is powered on.

In Step S1, it is determined whether or not the printer 11 is powered on. The determination process is performed by the first determination unit 125. The printer 11 can detects the operation of the power supply switch 11*a* even during the power OFF, and the power supply switch 11*a* is operated to operate a power supply circuit (not shown).

In Step S2, the drying device 17 is driven. That is, the temperature control unit 122 drives the fan motor 55, and supplies current to the heater 59 for heating. The temperature control unit 122 starts the warming-up of raising the temperature until the temperature in the drying device 17, that is, the detection temperature of the temperature sensor 61 reaches the target temperature (set temperature) according to the temperature raising program.

In Step S3, it is caused to be the de-curl ON. That is, the de-curl control unit 123 outputs the de-curl ON instruction to dispose the curl correcting mechanism 18 at the correction position in the motor driving circuit 105. As a result, as shown in FIG. 5A, the de-curl roller 36 is disposed at the de-curl position capable of pinching the sheet CS with the transport roller 26, the curl correcting mechanism 18 is in the de-curl ON state. For this reason, as shown in FIG. 5A, the warming-up of the drying device 17 is performed in the de-curl ON state in which the de-curl roller 36 comes in contract with the transport roller 26. For this reason, in the de-curl OFF state shown in FIG. 5B, the occurrence of the air current flowing from the drying area D to the outside of the body case 12, in which the gap of the de-curl roller pair DR is the flow path in the de-curl OFF state is significantly suppressed. As a result, the heat of the drying area D is prevented from getting out by the air current flowing to the outside. Accordingly, when the temperature of the drying device 17 reaches the target temperature, the temperature of the drying area D is raised to a temperature suitable for drying.

In Step S4, it is determined whether or not the temperature of the drying device 17 reaches the target temperature. The determination process is performed by the second determination unit 126.

In Step S5, it is determined whether or not a predetermined time is elapsed after the temperature of the drying device 17 reaches the target temperature. The predetermined time is a preset value. Because the contact state of the rollers 26 and 36 constituting the de-curl roller pair DR is continuously kept, indentation occurs on the roller surface in addition to the contact pressure unnecessary for the rollers 26 and 36. For this reason, when the sheet CS is not transported and the predetermined time is elapsed after the temperature of the drying device 17 reaches the target temperature, the process proceeds to Step S6, the contact pressure unnecessary for the rollers 26 and 36 is not added, and thus the de-curl roller 36 is disposed at the non-de-curl position separated from the transport roller 26, thereby being the de-curl OFF state. In this case, the de-curl control unit 123 outputs the de-curl OFF instruction to the motor driving circuit 105. Meanwhile, when the predetermined time is not elapsed after the temperature of the drying device 17 reaches the target temperature, the process proceeds to Step S7.

In Step S7, it is determined whether or not the printing job is received. The determination process is performed by the fourth determination unit 128. When the printing job is received, it is the de-curl ON in Step S8. That is, the de-curl control unit 123 outputs the de-curl ON instruction to the motor driving circuit 105. For this reason, when the predetermined time is elapsed after the temperature of the drying device 17 reaches the target temperature and the curl correcting mechanism 18 is in the de-curl OFF state, the de-curl roller 36 is moved from the non-de-curl position to the de-curl position. When the predetermined time is not elapsed after the temperature of the drying device 17 reaches the target temperature, and is already in the de-curl ON state, the de-curl ON state is kept. For this reason, even when the curl correcting mechanism 18 is in the de-curl OFF state, it is considered as the de-curl ON state when the printing job is received and the printing is performed from the current time, and the temperature of the drying area D is raised to a proper temperature until one sheet CS of the printing job reaches it.

In Step S9, it is determined whether or not the leading edge of the sheet CS is detected. When the leading edge of the sheet CS is detected, the de-curl operation start process is performed in Step S10. In the de-curl operation start process, in the printing job, the first sheet process started from the de-curl ON state, and the second and later sheet process started from the de-curl OFF state are different. That is, in the first sheet process, the de-curl control unit 123 switches from the de-curl ON state to the de-curl OFF state at the time point when the leading edge of the sheet CS is detected. The process thereafter is common in the first sheet and the second and later sheets. That is, the de-curl control unit 123 counts the transport distance of the sheet CS from the leading edge detection time point, the transport distance based on the count value reaches the first set distance, and the de-curl control unit 123 performs the de-curl ON at the timing when the leading edge of the sheet CS is inserted into the gap of the de-curl roller pair DR. As a result, the curl correcting mechanism 18 is changed from the de-curl OFF state shown in FIG. 4A to the de-curl ON state shown in FIG. 4B. The curl correction process is performed on the sheet CS by the curl correcting mechanism 18 in the de-curl ON state.

In Step S11, it is determined whether or not the trailing edge of the sheet CS is detected. When the trailing edge of the sheet CS is detected, the de-curl operation end process is performed in Step S12. That is, the de-curl control unit 123 counts the transport distance of the sheet CS from the trailing edge detecting time point, the transport distance based on the count value reaches the second set distance, the de-curl control unit 123 performs the de-curl OFF at the timing when the trailing edge of the sheet CS passes through the gap of the de-curl roller pair DR. That is, the curl correcting mechanism 18 is changed from the de-curl ON state shown in FIG. 4B to the de-curl OFF state shown in FIG. 4A. As a result, after the curl correction process is performed up to the trailing edge of the sheet CS, the curl correcting mechanism 18 is in the de-curl OFF state.

In Step S13, it is determined whether or not the printing job is completed. The determination is performed by the fourth determination unit 128. When the printing job is not completed, the subsequent sheet CS during the same printing job is transported. Accordingly, returning to Step S9, the processes of Step S9 to Step S12 are performed on the subsequent sheet CS to perform the curl correction process. In this case, the de-curl operation start process (S10) after the second sheet is started from the de-curl OFF state, and thus the first de-curl OFF such as the first sheet process is not performed. When the de-curl process on the last sheet CS during the printing job is completed, it is determined that the printing job is completed in Step S13. When it is determined that the printing job is completed, the de-curl ON is performed in Step S14. That is, when the printing job is completed, the curl correcting mechanism 18 is caused to be the de-curl ON irrespective of the presence or non-presence of the sheet transported thereafter, the de-curl roller 36 is moved to the de-curl position coming into contact with the transport roller 26 as shown in FIG. 5A, and the warm air passing through the de-curl roller pair DR is prevented from flowing from the drying area D to the downstream side in the transport direction X and flowing out of the body case 12. As a result, until the next printing job is received, the drying area D is kept at a proper temperature.

In Step S15, it is determined whether or not the power is OFF. When the power is not OFF, the process proceeds to Step S5. In Step S5, it is determined whether or not a predetermined time is elapsed. Before the first printing job is started after the power is supplied (power ON), the count unit 124 counts the elapsed time after the temperature of the drying device 17 reaches the target temperature by the instruction of the main control unit 121. Meanwhile, after the printing job is completed at the first time after the power is supplied (power ON), the count unit 124 counts the elapsed time from the de-curl ON time point (S14) performed after the completion of the printing job. In Step S5, according to the situation at that time, after the temperature of the drying device 17 reaches the target temperature, or after the de-curl ON after the printing job is completed, it is determined whether or not the predetermined time is elapsed. Meanwhile, when the power is OFF, the process proceeds to Step S16.

In Step S16, the driving of the drying device 17 is stopped, and the curl correcting mechanism 18 is the de-curl OFF. That is, Step S16 is the completion process of the printer 11, in which the completion process of the transport system or the printing system other than the completion process of the drying system is also performed.

Accordingly, in the printer 11 of the embodiment, the warm air blown from the outlet 53 of the drying device 17 remains, the drying area D formed by the remaining air can be kept at a relatively high temperature, and thus the drying of the ink on the sheet CS is promoted. For this reason, it is possible to raise the transport speed of the sheet CS proportionate to the time to dry the ink is shortened. As a result, it is possible to improve the printing throughput of the printer 11.

As described above, according to the embodiment, it is possible to obtain the following effects.

(1) During the temperature raising (warming-up) of the drying device 17 after the power is supplied to the printer 11, the curl correcting mechanism 18 is in the de-curl ON state when performing the curl correction. Accordingly, it is possible to more rapidly raise the temperature of the drying area D to the proper temperature, as compared with the configuration of raising the temperature of the drying device 17 in which the curl correcting mechanism 18 is in the de-curl OFF state. As a result, it is possible to start printing earlier from the time when the printer 11 is powered on.

(2) After completion of the warming-up, in the printing waiting state of waiting for the next printing job, the curl correcting mechanism 18 is in the de-curl ON state. For this reason, the flow path based on the gap of the de-curl roller pair DR is closed, and thus the temperature of the drying area D is not easily decreased as compared with the case of keeping the curl correcting mechanism 18 in the de-curl OFF state. For this reason, it is possible to efficiently perform the drying of the next sheet CS.

(3) When the waiting time when the curl correcting mechanism 18 waits in the de-curl ON state exceeds a regular time (a predetermined time) (that is, exceeds the period or the second period), the curl correcting mechanism 18 is switched to the de-curl OFF state. For this reason, the curl correcting mechanism 18 is left in the de-curl ON state over a long time, leaving is continuously repeated when using the printer 11, and thus it is possible to avoid indentation (dent) occurring at the contact part of the roller 26 and 36 constituting the de-curl roller pair DR. For example, when indentation occurs on the roller faces of the rollers 26 and 36, the sheet CS is not reliably pinched by the rollers 26 and 36 and is slightly slid, and thus the curl correction may not be appropriately performed. However, according to the embodiment, even when the curl correcting mechanism 18 is kept in the de-curl ON state for a predetermined time and when the next printing job is not received, it is switched to the de-curl OFF state. Accordingly, it is possible to avoid the curl correction not being appropriately performed due to indentation of the rollers 26 and 36 constituting the de-curl roller pair DR. The indentation is easy to occur, the durability of the de-curl roller pair DR extends, and it is possible to perform the proper curl correction over a long time by the curl correcting mechanism 18.

(4) When the curl correcting mechanism 18 receives the next printing job in the de-curl OFF state, the curl correcting mechanism 18 is switched to the de-curl ON state. For this reason, in the period until the sheet CS reaches the drying area D after the printing is started, the gap of the de-curl roller pair DR is closed, the temperature of the drying area D is raised, and it is possible to promote the drying of the sheet CS, as compared with the case where the sheet CS enters the drying area D in the de-curl OFF state where the gap of the de-curl roller pair DR is present.

(5) When the curl correcting mechanism 18 is kept in the de-curl ON state, the warm air easily remains in the second drying area D2. Accordingly, it is possible to also raise the temperature of the second drying area D2 as compared with the case of keeping it in the de-curl OFF state. For this reason, it is possible to promote the drying of the sheet CS.

(6) The de-curl plate 72 (guide member) provided to guide the sheet CS between the transport roller 26 and the de-curl roller 36 in the curl correcting mechanism 18 is disposed in a posture inclined in a direction in which the distance from the transport face is shortened by the downstream side in the transport direction X. Accordingly, the warm air leaked from the first drying area D1 to the downstream side in the transport direction X easily remains further to the upstream side in the transport direction X than that, in which the de-curl plate 72 is the flow path resistance, and it is possible to form the second drying area D2 on the downstream side of the first drying area D1. As a result, the drying area D is expanded to the downstream side in the transport direction, the expanded drying area D is transported, and thus it is possible to promote the drying of the sheet CS.

The embodiment may be modified to the following aspects.

The time of keeping the curl correcting mechanism 18 in the de-curl ON state is not counted by the count unit 124, and the curl correcting mechanism 18 may be continuously kept in the de-curl ON state.

A configuration of causing the de-curl ON state may be configured only by at least period of the period until the predetermined time is elapsed after the completion of the temperature raising (warming-up) of the drying device 17 and the second period until the predetermined time is elapsed after the completion of the printing job. The control of keeping in the de-curl ON state in the period and the second period may not be performed, and only the control of keeping in the de-curl ON state may be employed in the course of the temperature raising (warming-up) of the drying device 17.

The sequence of Steps S12 and S13 in FIG. 7 is switched, the de-curl operation end process is performed when the printing job is not completed. However, the de-curl ON state may be kept without performing the de-curl operation end process when the printing job is completed, and the configuration of omitting the process of the de-curl ON may be employed in Step S14.

The transport roller pair R3 further to the downstream side in the transport direction than the outlet 53 may not be provided, and the drying area D may be formed between the transport roller pair R2 on the upstream side and the de-curl plate 72.

The printing apparatus is not limited to the serial printer, and may be an ink jet line printer. In this case, the printing head may be any one of a full-line printing head and a multi-head printing head.

In the embodiment, the printing apparatus is embodied to the ink jet printing apparatus, but is not limited thereto, and may be embodied to a liquid ejecting apparatus that ejects or sprays a liquid other than the ink (including a liquid body in which functional material particles are dispersed or mixed in the liquid or a flow body such as a gel). For example, the printing apparatus may be a liquid ejecting apparatus that ejects a liquid body including a material such as an electrode material or a color material (a pixel material) used in production of a liquid crystal display, an EL (electroluminescence) display and a surface emitting display, in a dispersion form or a dissolution form. The printing apparatus may be a liquid ejecting apparatus that ejects a bio-organic material used in production of a bio chip and a liquid ejecting apparatus that ejects a liquid that is a sample used as a precise pipette. The printing apparatus may be a liquid ejecting apparatus that ejects a transparent resin liquid such as thermosetting resin onto a substrate to form a small hemisphere lens (an optical lens) used in an optical communication element or the like, a liquid ejecting apparatus that ejects an etching liquid such as acid or alkali to etch a substrate or the like, and a flow body ejecting apparatus that ejects a flow body such a gel (for example, a physical gel). The invention may be applied to one kind of fluid ejecting apparatus of any one of them. As described above, the printing medium is not limited to the sheet (continuous sheet or single sheet) such as paper, and may be a substrate in which an element or a line is formed by ink jet. The printing medium may be a sheet formed of synthetic resin or metal. In the specification, the "liquid" includes a liquid (an inorganic solvent, an organic solvent, a solution, a liquid resin, a liquid metal (metal melt), and the like), a liquid-like body, and a flow body. In short, it is sufficiently a liquid in which the drying is necessary by the dry air from the drying unit.

What is claimed is:

1. A printing apparatus comprising:

a transport unit that transports a printing medium subjected to recording by adhering of a liquid from an upstream side to a downstream side in a transport direction;

a printing head that performs printing on the printing medium in the course of a transport path;

a drying unit that performs a drying process on the printing medium in the course of the transport path of the printing medium;

a control device; and a curl correcting unit including:

a transport roller; and a de-curl roller, wherein the transport roller is disposed further downstream in the transport direction than the drying unit, the de-curl roller is configured to correct curling of the printing medium by pinching the printing medium with the transport roller, wherein the control device controls the curl correcting unit to move the de-curl roller between a de-curl position where the printing medium is pinched by the de-curl roller and the transport roller and a non-de-curl position wherein the de-curl roller is separated from the transport roller, and wherein the de-curl roller is positioned at the de-curl position at a time of increasing the drying unit to a predetermined temperature.

2. The printing apparatus according to claim 1, wherein even when the temperature of the drying unit reaches the predetermined temperature and the temperature increase is completed, the curl correcting unit is kept at the de-curl position as long as a printing job of instructing printing to the printing medium is not received.

3. The printing apparatus according to claim 2, wherein when a period until a predetermined time is elapsed is completed after the temperature of the drying unit reaches the predetermined temperature and the temperature increase is completed, the curl correcting unit is disposed from the de-curl position to the non-de-curl position even when the printing job is not received.

4. The printing apparatus according to claim 3, wherein when the printing job is received after the curl correcting unit is disposed at the non-de-curl position after the period, the curl correcting unit is disposed at the de-curl position.

5. The printing apparatus according to claim 1, wherein even when the curl correcting unit completes the curl correction of the last printing medium in the printing job of instructing printing to the printing medium, the curl correcting unit is kept at the de-curl position as long as the next printing job is not received.

6. The printing apparatus according to claim 5, wherein in a second period until a predetermined time is elapsed after the curl correcting unit completes the curl correction of the last printing medium of the printing job, the curl correcting unit is disposed at the de-curl position as long as the next printing job is not received, and after the second period is elapsed, the curl correcting unit is disposed at the non-de-curl position.

7. The printing apparatus according to claim 1, wherein the curl correcting unit is provided with a guide member that guides the printing medium between the transport roller and the de-curl roller, and the guide member is disposed in an inclined posture such that a distance from a transport face is shortened as much as the downstream side in the transport direction.

* * * * *